US009466903B2

(12) United States Patent
Kajiura et al.

(10) Patent No.: US 9,466,903 B2
(45) **Date of Patent: *Oct. 11, 2016**

(54) HIGH SPEED FLEXIBLE PRINTED CIRCUIT CONNECTOR

(71) Applicant: FCI Asia Pte. Ltd., Singapore (SG)

(72) Inventors: Motomu Kajiura, Tokyo (JP); Naotaka Sasame, Saitama (JP); Masashiko Motoyama, Kanagawa (JP)

(73) Assignee: FCI ASIA PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,545

(22) Filed: Aug. 31, 2015

(65) Prior Publication Data

US 2015/0372406 A1 Dec. 24, 2015

Related U.S. Application Data

(63) Continuation of application No. 13/880,836, filed as application No. PCT/IB2011/002853 on Oct. 14, 2011, now Pat. No. 9,153,888.

(51) Int. Cl.

| | |
|---|---|
| ***H01R 13/62*** | (2006.01) |
| ***H01R 12/77*** | (2011.01) |
| ***H01R 12/88*** | (2011.01) |
| ***H01R 13/6471*** | (2011.01) |
| ***H01R 12/72*** | (2011.01) |

(Continued)

(52) U.S. Cl.

CPC ..... *H01R 12/774* (2013.01); *H01R 12/72* (2013.01); *H01R 12/79* (2013.01); *H01R 12/88* (2013.01); *H01R 13/6471* (2013.01); *H01R 13/6477* (2013.01); *H01R 13/6597* (2013.01)

(58) Field of Classification Search

CPC ..... H01R 12/88; H01R 12/79; H01R 12/07; H01R 13/24; H01R 23/6842; H01R 13/6594; H01R 13/6597; H01R 13/6461; H01R 13/652; H01R 12/727; H01R 12/75

USPC ..... 439/329, 493, 495, 497, 260, 607.32

See application file for complete search history.

(56) References Cited

U.S. PATENT DOCUMENTS

| | | | | |
|---|---|---|---|---|
| 5,738,545 | A | 4/1998 | Igarashi et al. | 439/607.36 |
| 6,478,612 | B2 | 11/2002 | Okano | 439/495 |

(Continued)

FOREIGN PATENT DOCUMENTS

| | | |
|---|---|---|
| CN | 1515052 A | 7/2004 |
| CN | 1742411 A | 3/2006 |

(Continued)

*Primary Examiner* — Xuong Chung Trans

(74) *Attorney, Agent, or Firm* — Harrington & Smith

(57) ABSTRACT

A high speed flexible printed circuit (FPC) connector includes a housing with ground and signal contact terminal pairs arranged in the housing in a staggered manner along a lateral direction. The housing has a cavity for receiving an FPC board therein. Each ground contact terminal has an upper arm positioned adjacent to a top wall of the cavity and a lower arm positioned adjacent to a bottom wall of the cavity. Each signal contact terminal has only a lower arm positioned adjacent to the bottom wall of the cavity. Signal contact terminals with the only lower arm provide the connector with better signal integrity. An actuator is coupled to the housing for fixing the FPC board in the cavity to establish electrical connections. The actuator has recesses corresponding to the positions of the signal pairs to provide a dielectric constant different from that of the other parts of the actuator.

16 Claims, 10 Drawing Sheets

(51) Int. Cl.

| | |
|---|---|
| ***H01R 12/79*** | (2011.01) |
| ***H01R 13/6477*** | (2011.01) |
| *H01R 13/6597* | (2011.01) |

(56) References Cited

U.S. PATENT DOCUMENTS

| | | | | |
|---|---|---|---|---|
| 6,855,002 | B2 | 2/2005 | Chiu | 439/495 |
| 7,637,763 | B1 | 12/2009 | Peng | 439/260 |
| 7,695,311 | B2 | 4/2010 | Nemoto | 439/495 |
| 8,025,516 | B2 | 9/2011 | Yokoo et al. | 439/260 |
| 8,622,766 | B2 | 1/2014 | Yokoo et al. | 439/495 |
| 8,662,915 | B2 | 3/2014 | Ueda et al. | 439/493 |
| 2007/0004282 | A1 | 1/2007 | Cohen et al. | 439/608 |
| 2007/0032104 | A1 | 2/2007 | Yamada et al. | 439/76.1 |
| 2008/0220644 | A1 | 9/2008 | Yamada et al. | 439/352 |

FOREIGN PATENT DOCUMENTS

| | | | |
|---|---|---|---|
| CN | 101273501 | A | 9/2008 |
| CN | 101859948 | A | 10/2010 |
| JP | 2008053123 | A | 3/2008 |
| JP | 2008186600 | A | 8/2008 |
| WO | WO-2004/030158 | A2 | 4/2004 |

HIGH SPEED FLEXIBLE PRINTED CIRCUIT CONNECTOR

CROSS REFERENCE TO RELATED APPLICATION

This is a continuation patent application of U.S. Patent Application Ser. No. 13/880,836 filed Jun. 10, 2013, which is a national stage application of PCT Application No. PCT/IB2011/002853 filed Oct. 14, 2011, which claims priority on Application No. PCT/IB2010/003029 filed Oct. 22, 2010, which are all hereby incorporated by reference in their entireties.

FIELD OF THE INVENTION

The present invention relates to an electrical connector, and more particularly to an electrical connector for connecting to a flexible printed circuit board.

BACKGROUND OF THE INVENTION

Flexible printed circuit (FPC) connectors are widely used in many electronic devices and systems for transmitting electrical signals. Conventional FPC connectors suffer signal integrity degradation and therefore are difficult to transmit signal in high speed. The present invention provides FPC connectors which are capable of transmitting signals in high speed and with improved signal integrity.

SUMMARY OF THE INVENTION

According to one aspect, embodiments of the present invention provides a high speed flexible printed circuit (FPC) connector which includes a housing with ground and signal terminals arranged in the housing along a lateral direction. The housing has a cavity for receiving an FPC board therein. Each ground terminal has a first branch arm positioned adjacent to a bottom wall of the cavity and a second branch arm positioned adjacent to a top wall of the cavity. Each signal terminal is of a single, non-branched elongated shape and the signal terminals are positioned adjacent to the bottom wall of the cavity. Every two of the signal terminals are positioned adjacent to each other to form a signal terminal pair for differential signal transmission. Each signal pair is sandwiched between the first branch aims of two ground terminals. Signal terminals without branch can provide the connector with better signal integrity. An actuator is coupled to the housing for fixing the FPC board in the cavity to establish electrical connections. The actuator may have recesses corresponding to the positions of the signal pairs to provide a dielectric constant different from that of the other parts of the actuator.

For a better understanding of the present invention and its purpose and preferred embodiments, further description accompanied by figures is provided in detail below.

DETAILED DESCRIPTION OF PREFERRED EMBODIMENTS

Figure 1:
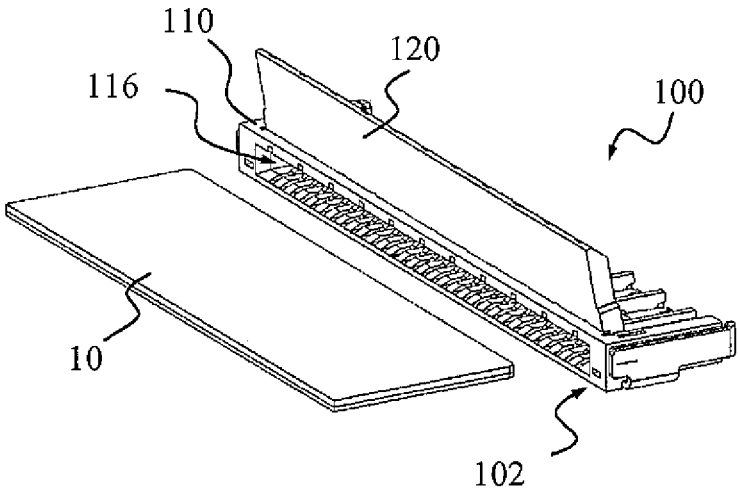
FIG. 1 is a perspective front view of an FPC connector according to one embodiment of the present invention and to be connected to an FPC board.
Figure 2:
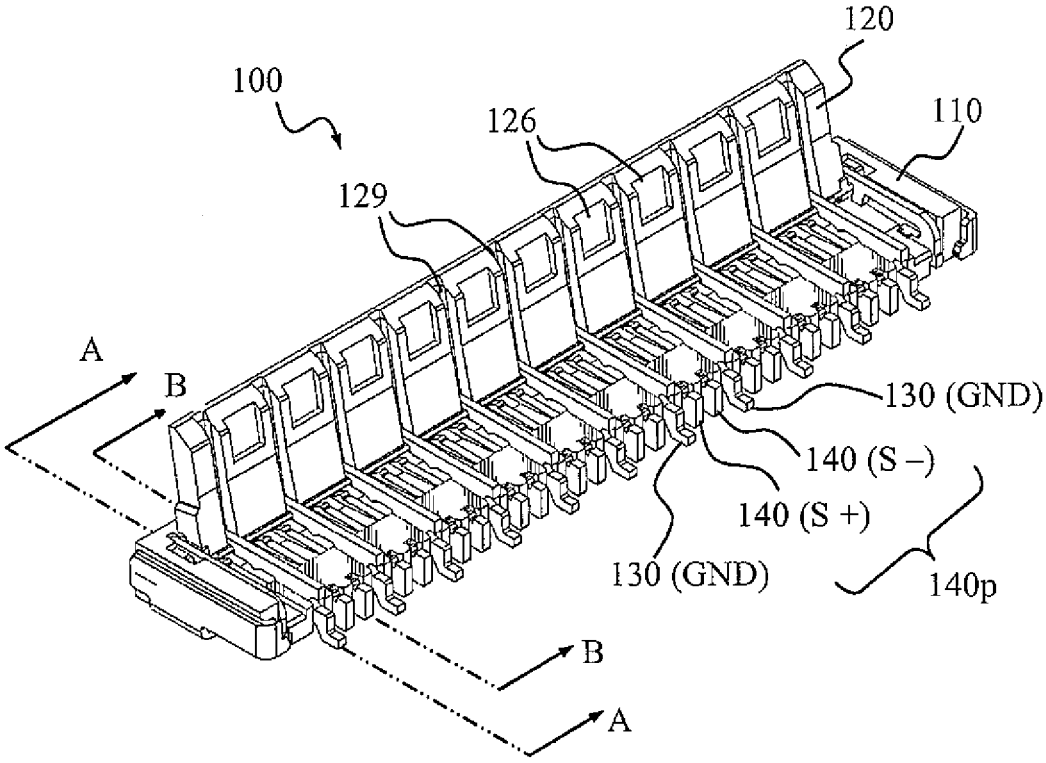
FIG. 2 is a perspective rear view of the connector shown in FIG. 1
Figure 3:
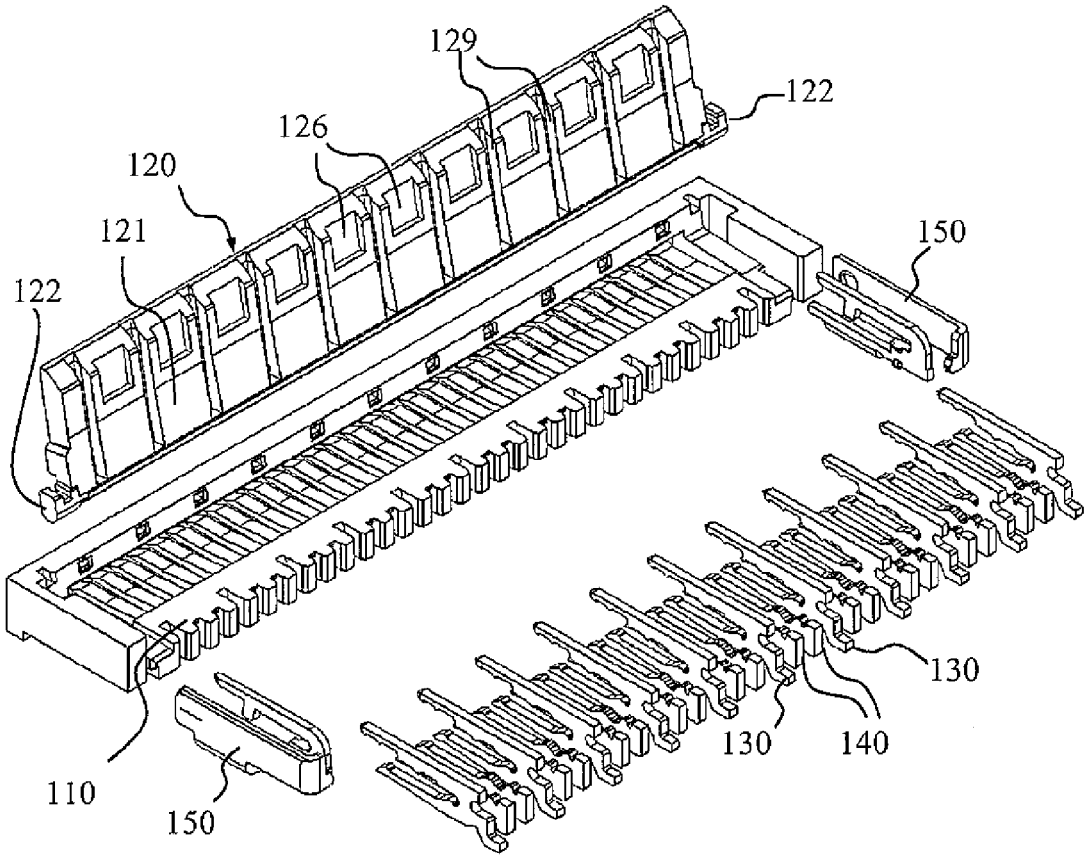
FIG. 3 is an exploded view of FIG. 2.

As shown in FIGS. 1, 2 and 3, an FPC connector 100 according to one embodiment of the present invention includes a housing 110 and an actuator 120 pivotally attached to housing 110. A plurality of first and second sets of terminals 130 and 140 are arranged in housing 110. Housing 110 has a cavity 116 accessible from front end 102 of connector 100. Cavity 116 is to allow insertion of an end portion of an FPC board 10 therein, by which an electrical connection can be established between FPC board 10 and connector 100. An actuator 120 is coupled to housing 110 and supported by a pair of brackets 150 which are mounted to housing 110.

Figure 4:
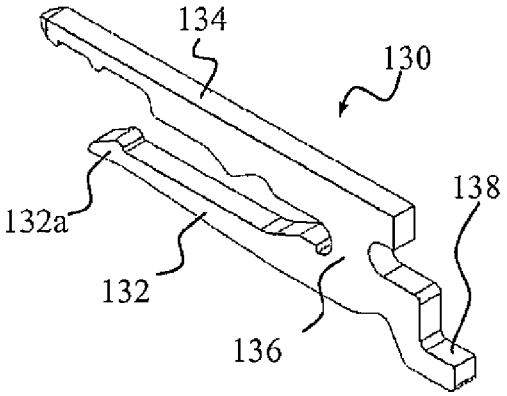
FIG. 4 is a perspective view of a first type of contact terminal of the connector shown in FIG. 1.

As shown in FIG. 4, each of the first set of terminals 130 has a first branch arm 132 at lower side and second branch arm 134 at upper side. First and second branch arms 132 and 134 are connected integrally to a base portion 136. With reference to the orientation shown in FIG. 4, at distal end of first branch arm 132 there is formed a first contact projection 132*a*. First branch arm 132 extends backwardly beyond base portion 136, and forms a first tail portion 138 at the proximal end of first branch arm 132.

Figure 5:
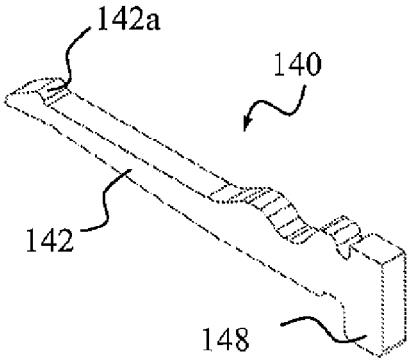
FIG. 5 is a perspective view of a second type of contact terminal of the connector shown in FIG. 1.

As shown in FIG. 5, each of the second set of terminals 140 is of a generally elongated shape having a contact arm 142. At distal end of contact arm 142 there is formed a second contact projection 142*a*. At proximal end of contact arm 142 there is formed a second tail portion 148.

Figure 6:
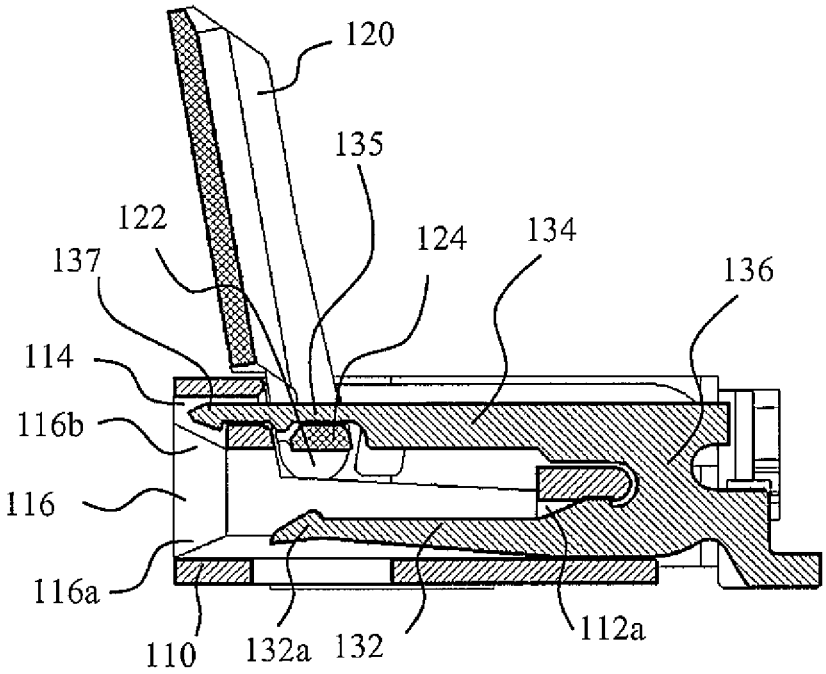
FIG. 6 is a cross-sectional view of FIG. 2 along A-A.

As shown in FIG. 6, first set of terminals 130 (only one is shown) are fixed to housing 110. First branch arm 132 of each of first set of terminals 130 is inserted into housing 110 through a first fixing slot 112*a*. A front tip 137 of second branch arm 134 of each of first set of terminals 130 is inserted into a second fixing slot 114 of housing 110. Actuator 120 is coupled to housing 110 with pivot 122 held to housing 110 by holding portion 135 formed on second branch arm 134 between tip 137 and base portion 136 of first contact terminals 130. With the holding action provided by second branches 134 of first set of terminals 130, actuator 120 is prevented from being detached from housing 110, but is allowed to rotate relative to housing 110 about pivot 122. After first set of terminals 130 are assembled to housing 110, first branch arms 132 are positioned at a bottom side 116*a* of cavity 116, and second branch arms 134 are positioned at a top side 116*b* of cavity 116.

Figure 7:
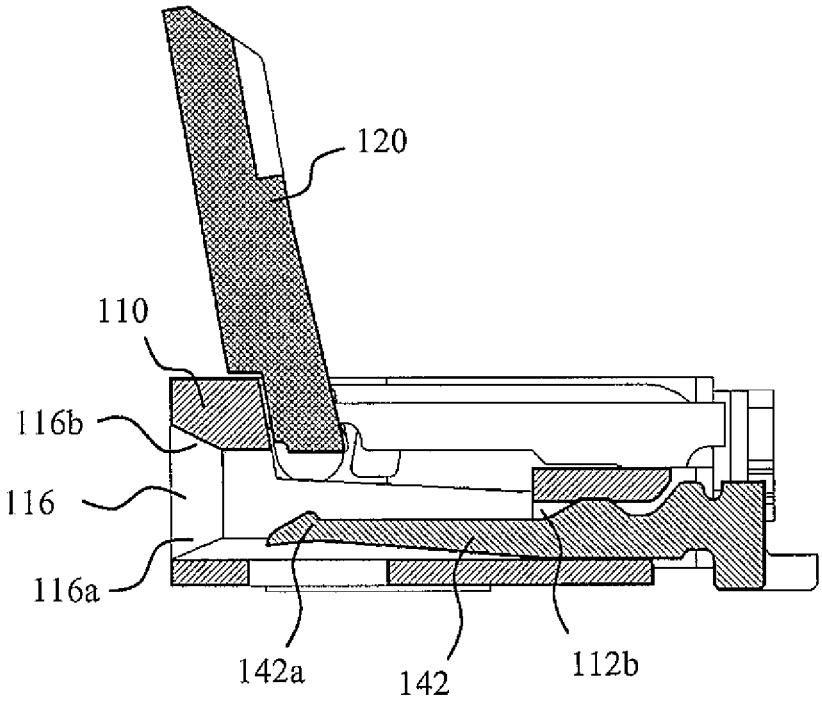
FIG. 7 is a cross-sectional view of FIG. 2 along B-B.

As shown in FIG. 7, second set of terminals 140 (only one is shown) are fixed to housing 110, with contact arm 142 inserted through a third fixing slot 112*b*. After being assembled to housing 110, second set of terminals 140 are positioned at a bottom side 116*a* of cavity 116. As such, at bottom side 116*a* of cavity 116, there are arranged both the first branch arms 132 of first set of terminals 130 and the second set of terminals 140. At top side 116*b*, there are arranged only the second branch arms 134 of first set of terminals 130. Another words, between two adjacent ones of the first branch arms 132, there are disposed two contact arms 142 of second set of terminals 140, but between two adjacent ones of the second branch arms 142, there is no any part of second set of terminals 140 being disposed therein. Instead, there is formed a space between two adjacent ones of the second branch arms 142.

First branch arm 132 and contact arm 142 are now fixed to housing 110 in a cantilevered manner, hence first contact projection 132*a* and second contact projection 142*a* extend into, and become resiliently deflectable within, cavity 116 of housing 110.

The first set of terminals 130 are configured as ground terminals 130 for connector 100, denoted in FIG. 2 as "GND (ground)" terminals. Every two of the second terminals 140 are positioned next to each other to form a signal contact pair 140*p*, denoted in FIG. 2 as "S+" and "S−" terminals for connector 100, for transmission of a pair of differential signals. The ground terminals 130 and signal contact pairs 140*p* are arranged in housing 110 in a staggered manner, i.e. each signal contact pair 140*p* is sandwiched between two adjacent first branch arms 132 of ground terminals, as shown in FIG. 2.

Figure 8:
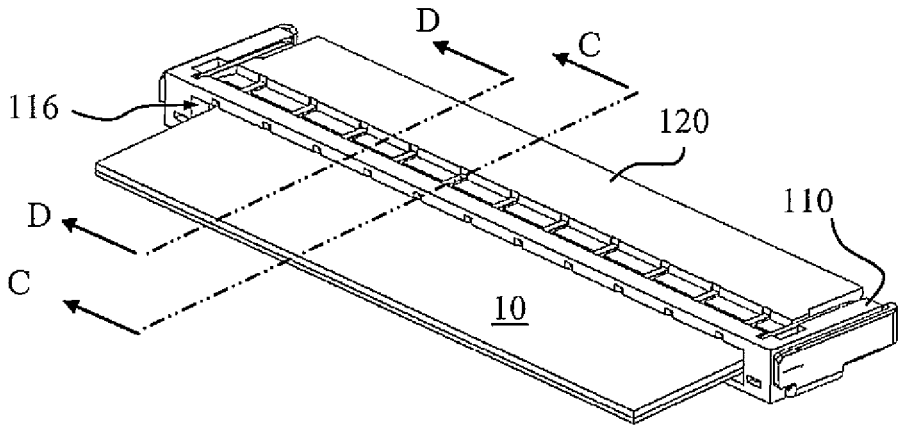
FIG. 8 is a perspective view of FIG. 1 when the FPC board is connected to the connector.
Figure 9:
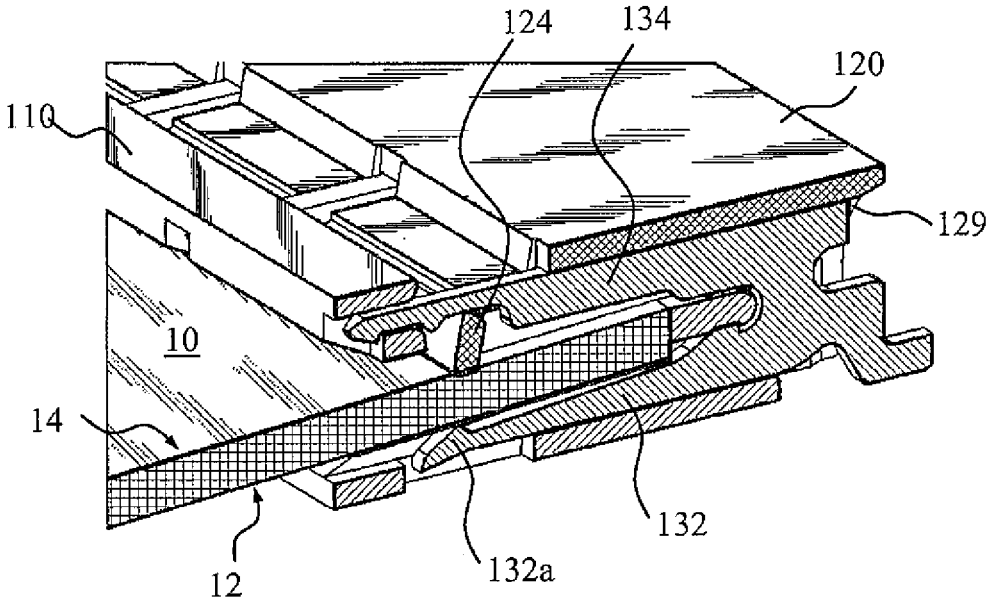
FIG. 9 is a cross-sectional view of FIG. 8 along C-C.
Figure 10:
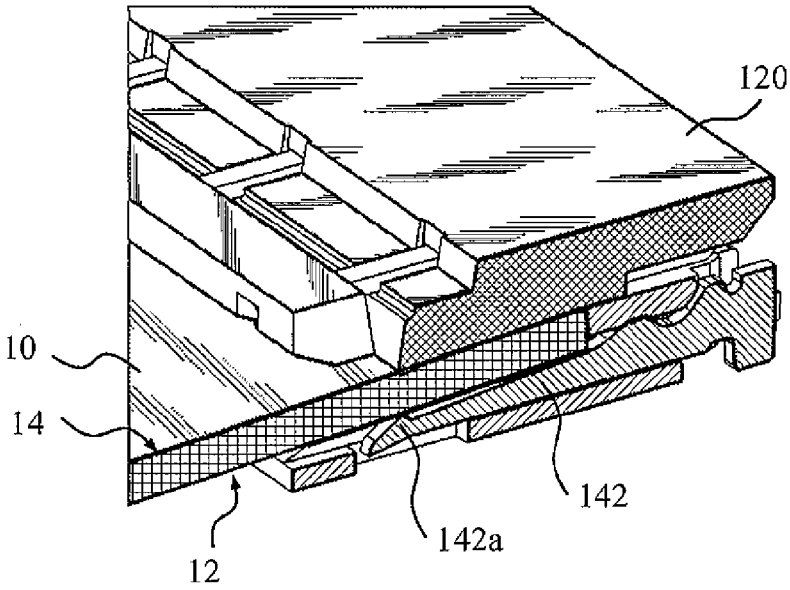
FIG. 10 is a cross-sectional view of FIG. 8 along D-D.
Figure 11:
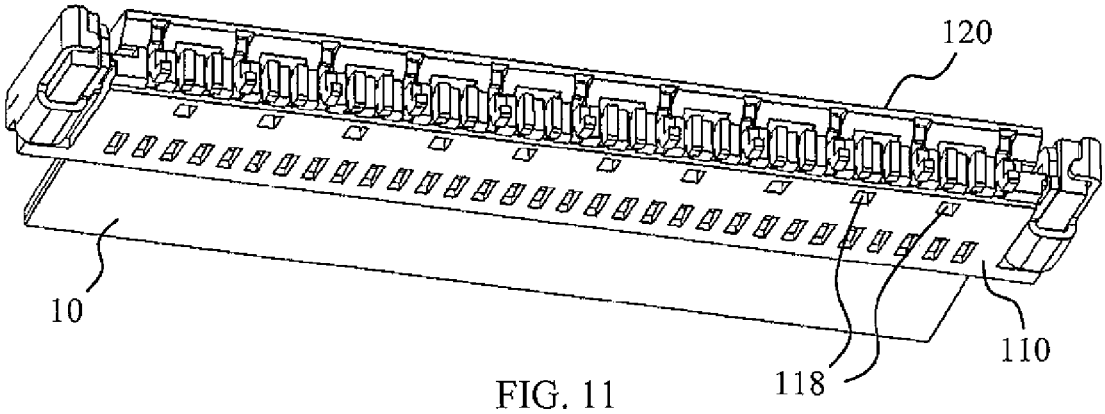
FIG. 11 is a perspective bottom view of FIG. 8.
Figure 12:
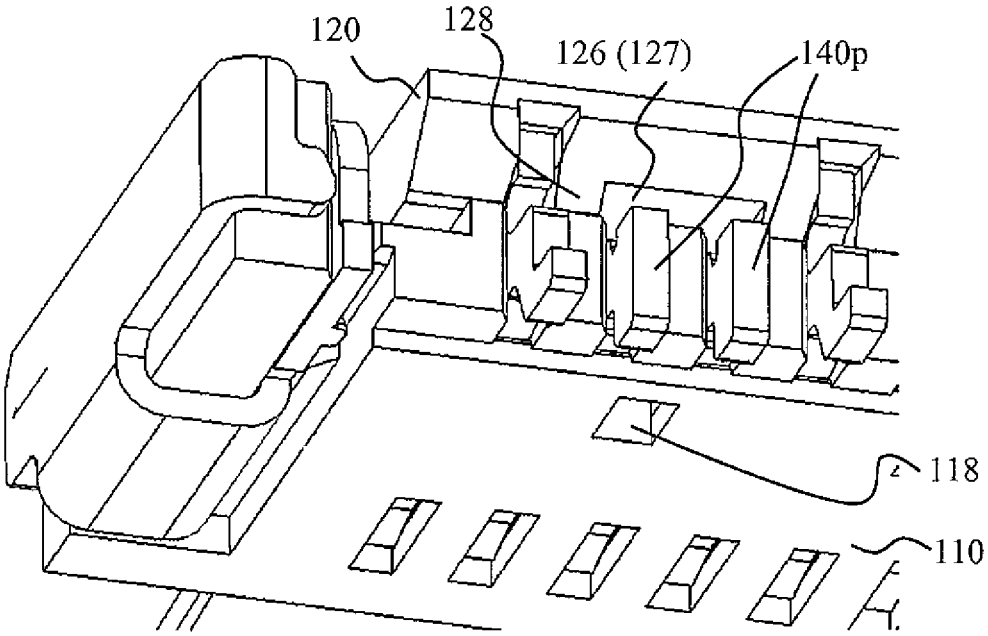
FIG. 12 is a partial enlarged view of FIG. 11.
Figure 13:
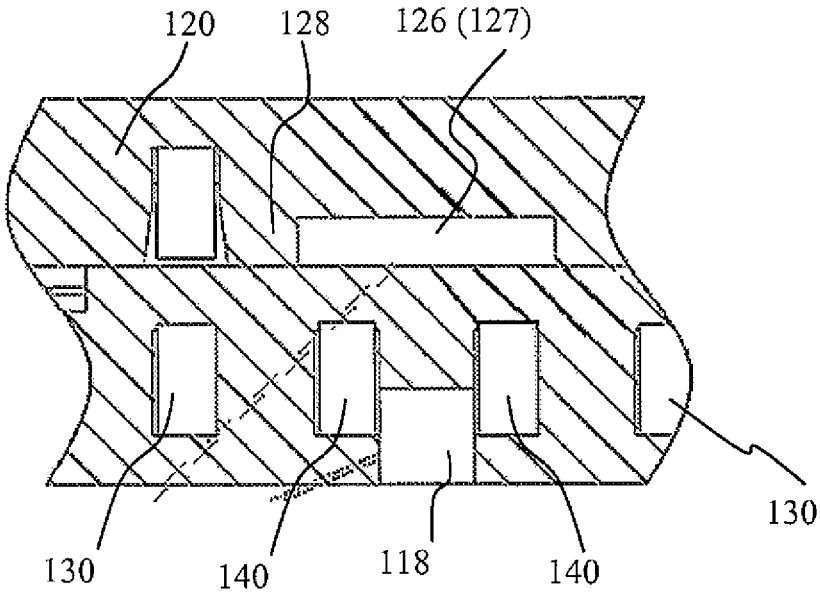
FIG. 13 is a partial cross sectional view of FIG. 12.

As shown in FIGS. 8, 9 and 10, when in use, the front end of an FPC board 10 is inserted into cavity 116 of housing 110, and actuator 120 is rotated from a release position (FIGS. 6 and 7) to a lock position (FIGS. 8, 9 and 10). At the lock position, a cam 124 formed on actuator 120 presses against top surface 14 of FPC board 10, which causes bottom surface 12 of FPC board 10 to contact with contact projection 132*a* of first branch arm 132 of each of the first set of terminals 130, as well as contact projection 142*a* of contact arm 142 of each of the second set of terminals 140. Electrical connections can therefore be established between FPC board 10 and terminals 130 and 140. Since second set of terminals 140 which serve as the signal contact terminals do not have any upper arm, as is the case of the first contact terminals 130, the negative effects to signal integrity caused by conventional contact terminals having such upper arm, can be eliminated or at least substantially reduced. Only the first set of terminals 130, which serve as ground contact terminals, have the upper arms which hold the actuator 120 to housing 110 and support the operation of actuator 120. In this way, actuator 120 is allowed to rotate and can be prevented from being detached from housing 110.

Actuator 120 maybe formed with recesses 126 on its main plate 121, as shown in FIGS. 2, 11, 12 and 13. Recesses 126 are located such that when actuator 120 is at the lock position, each recess 126 overlaps one signal contact pair 140*p* of second set of terminals 140, providing an air gap 127 above each signal pair 140*p*. Air gaps may be used to provide a dielectric constant (i.e. dielectric constant of air) different from that of the adjacent parts 128 (i.e. dielectric constant of the actuator material of e.g. plastic) of actuator 120, to further improve the signal integrity, and to increase the signal transmission speed.

Additionally, actuator 120 maybe formed with grooves 129 on main plate 121, as shown in FIGS. 2, 3 and 9. Each groove 129 is located between two adjacent recesses 126 and corresponding to the locations of second branch arm 134 of first set of terminals 130. When actuator is at the lock position, as shown in FIG. 9, each of the second branch arms 134 of first set of terminals 130 is partially received into a corresponding groove 129. One would appreciate that grooves 129 can be useful to reduce the thickness of actuator and hence to reduce the overall thickness of connector 100.

Further, between two of the second contact terminals 140, there may be formed air spaces in the form of voids 118 in housing 110. The shape and dimension of voids 118 may vary, providing dielectric constant of air different from other part of housing 110 which are made of housing material, e.g. plastic. Voids 118 are therefore useful to further adjust the signal properties to match the signal transmission requirements.

Figure 14:
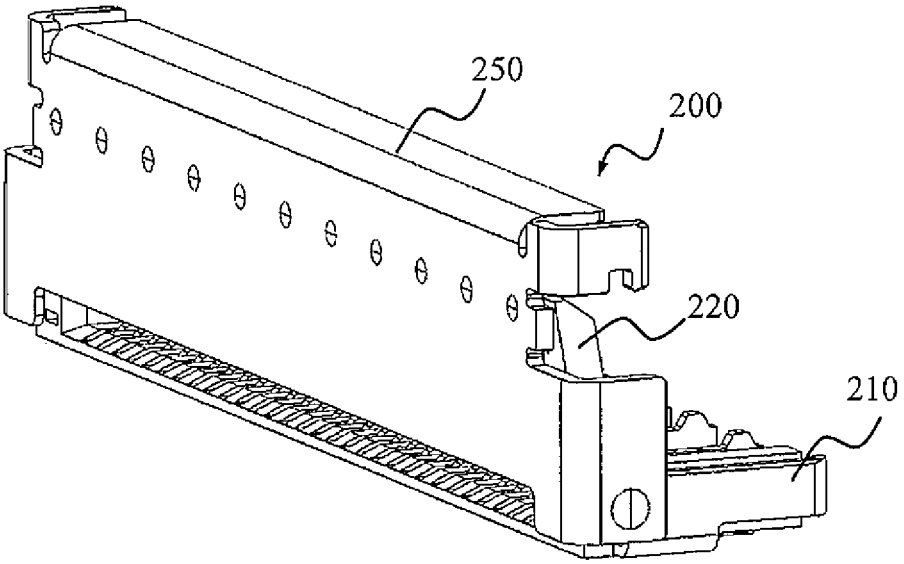
FIG. 14 is a perspective front view of an FPC connector according to another embodiment of the present invention.
Figure 15:
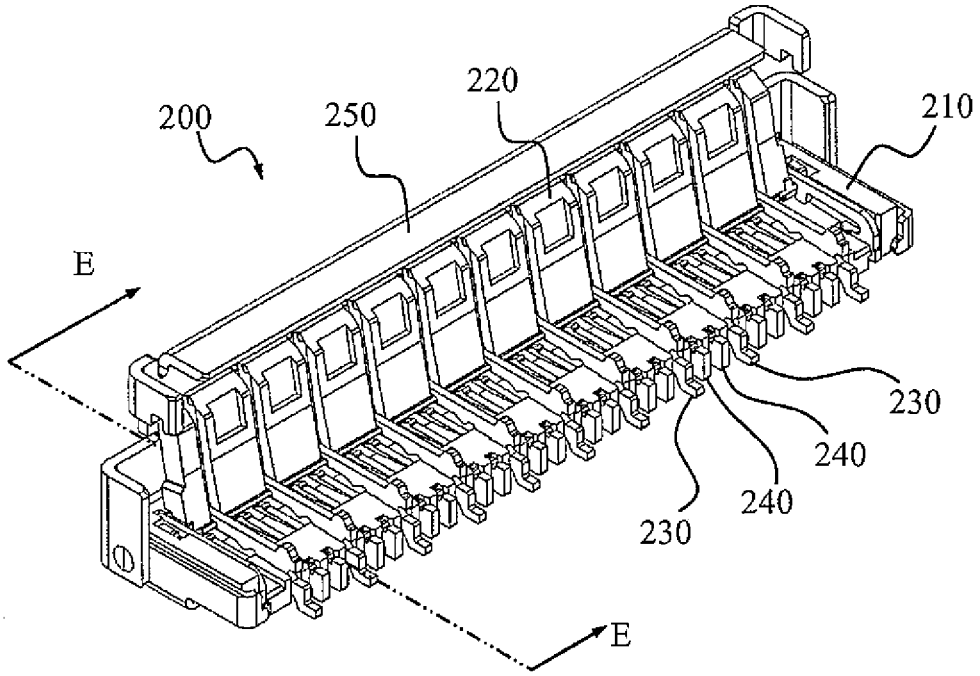
FIG. 15 is a perspective rear view of FIG. 14.
Figure 16:
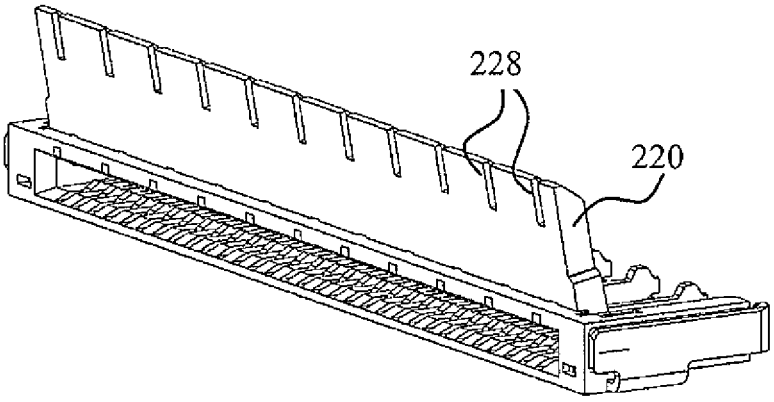
FIG. 16 is a perspective front view of FIG. 14 with the metal cover omitted.

According to another embodiment of the present invention, as shown in FIGS. 14, 15 and 16, a connector 200 has a housing 210 and an actuator 220 pivotally attached to housing 210. A plurality of first and second sets of terminals 230 and 240 are arranged in housing 210, in a manner the same as that of the previous embodiment. Second set of terminals 240, which serve as signal contacts, have the same structure as that of the previous embodiment. However, first set of terminals 230 are structured differently, as illustrated below in further details.

Connector 200 further includes a metal cover 250 coupled to housing 210, to provide a shielding effect as well as an additional grounding effect to connector 200. Metal cover 250 is rotatable relative to housing 210 between an open position (FIG. 17) to allow actuator 220 to move to the release position, and a close position (FIG. 19) to enclose actuator 220 when the actuator 220 is at the lock position.

Figure 17:
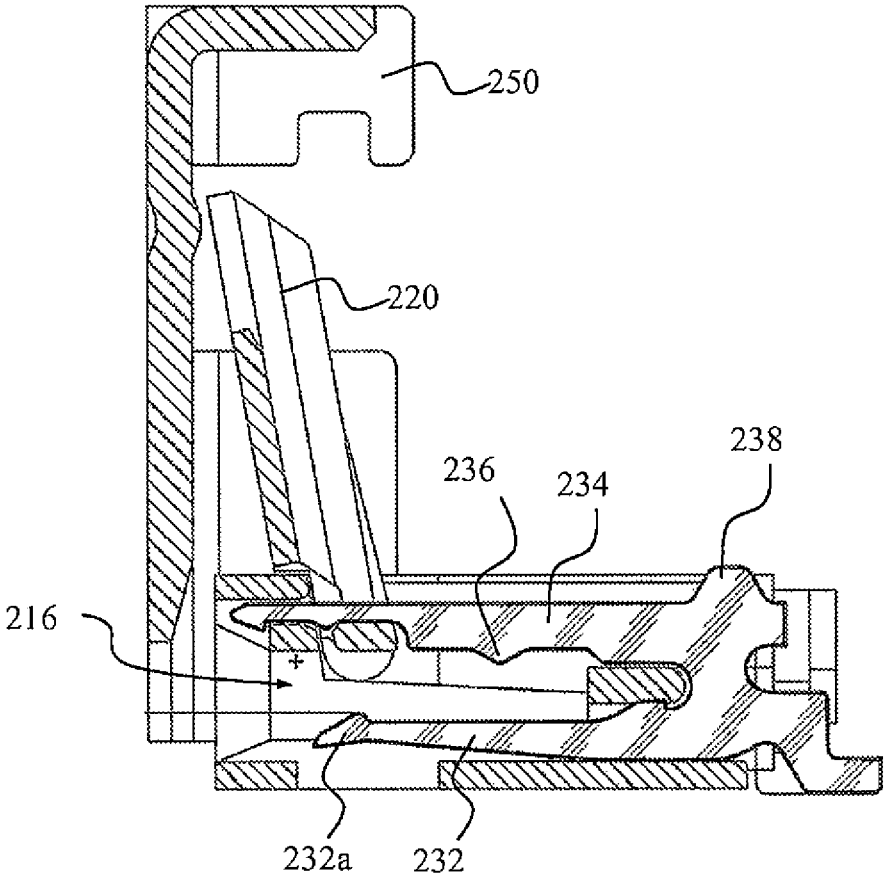
FIG. 17 is a cross-sectional view of FIG. 17 along E-E.

As shown in FIG. 17, each of the first set of terminal 230 has a first branch arm 232 at lower side, with a contact projection 232*a* at frond end (left side of FIG. 17) thereof, for contacting to an FPC board. Second branch arm 234 of first contact terminal 230 at upper side has a first projection 236 and a second projection 238 formed thereon. First projection 236 extends into cavity 216 towards lower arm 232. Second projection 238 extends in an opposite direction from upper arm 234.

Figure 18:
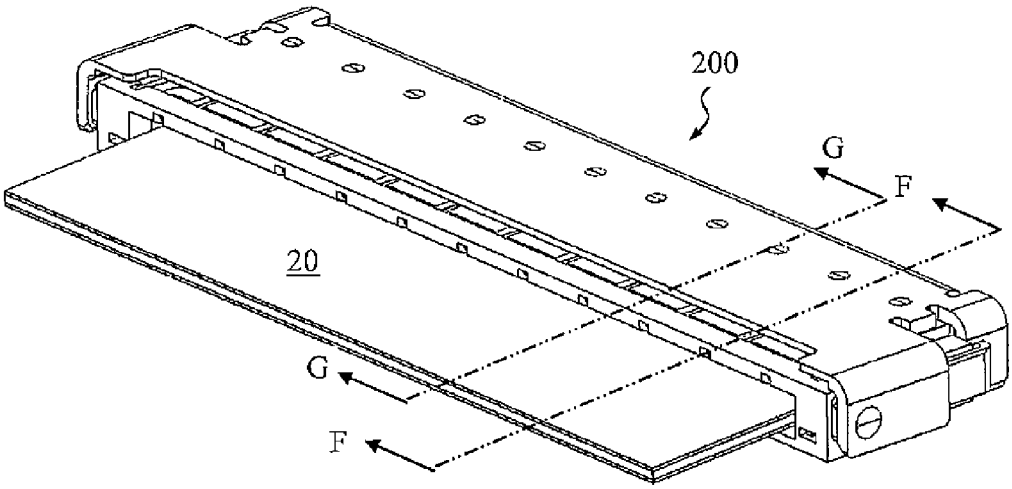
FIG. 18 is a perspective view of FIG. 14 when an FPC board is connected to the connector.
Figure 19:
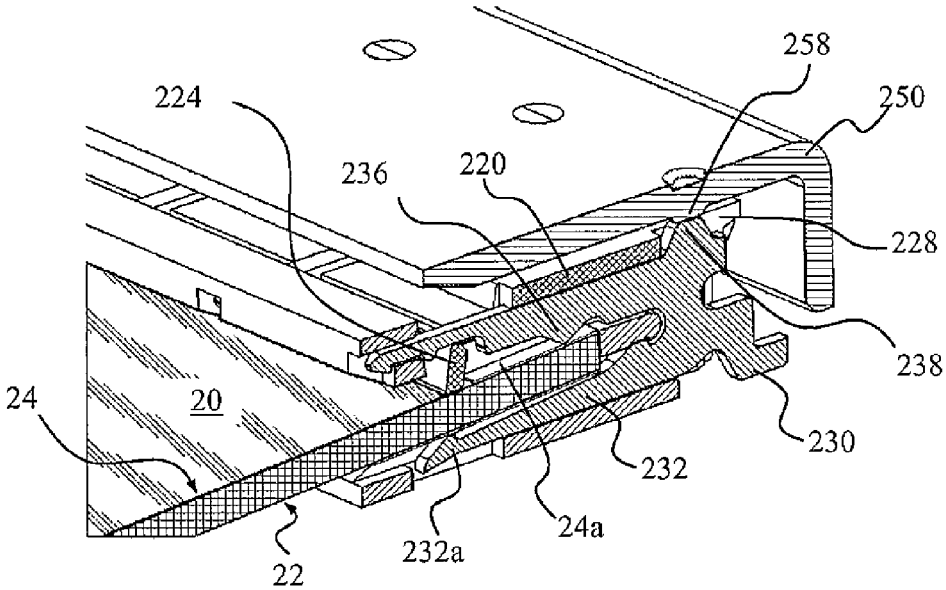
FIG. 19 is a cross-sectional view of FIG. 18 along F-F.
Figure 20:
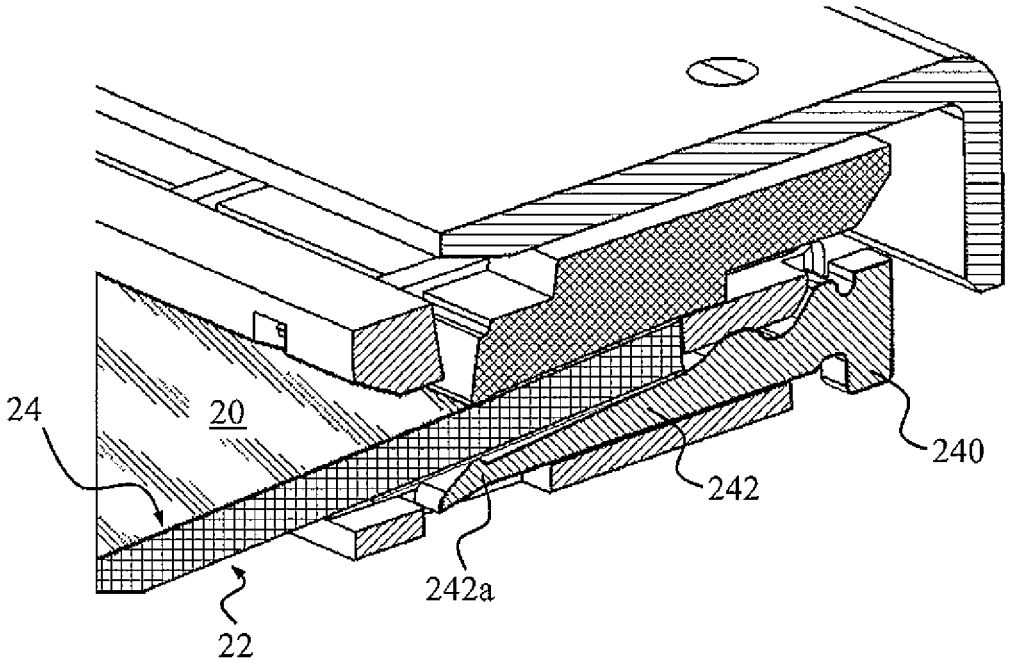
FIG. 20 is a cross-sectional view of FIG. 18 along G-G.

As shown in FIGS. 18, 19 and 20, when in use, an FPC board 20 is inserted with its front end portion into cavity 216 of housing 210, and actuator 220 is closed so as to fix FPC board 20 to housing 210. Cam 224 of actuator 220 now presses against the top surface 24 of FPC board 20 which causes the bottom surface 22 to contact first contact protections 232*a* of first set of terminals 230 as well as second contact projections 242*a* of second set of terminals 240. Meanwhile, top surface 24 of FPC board 20 is brought into contact with first projection 236 to establish electrical connections between circuits 24*a* (serving as ground-contacts) on top surface 24 of FPC board 20 and first contact terminal 230.

On actuator 220 there are formed of a plurality of openings 228 (FIG. 16) corresponding to the positions of second projections 238 such that, when actuator 220 is rotated to the lock position, as shown in FIG. 19, second projections 238 pass though openings 228 and are accessible from top side of actuator 220.

At positions corresponding to second projections 238, there may be formed a plurality of bosses 258 on metal cover

250. When metal cover 250 is rotated to close position to complete the FPC board connection to connector 200, each boss 258 is brought into contact with a respective second projection 238 of first set of terminals 230. A grounding path is therefore established between ground circuit 24*a* of FPC board 24 and metal cover, by the contact between ground circuit 24*a* and first projection 236, and the contact between second projection 238 and boss 258 of metal cover 250. Grounding effect is further improved in this regard.

The invention claimed is:

1. An electrical connector comprising: a housing having a cavity for receiving a circuit board therein; an actuator coupled to the housing and rotatable relative to the housing between a release position to allow the circuit board to be inserted into the cavity and a lock position to fix the circuit board in the cavity; signal terminals and ground terminals arranged in the housing, wherein each ground terminal includes a base portion, a first branch arm and a second branch arm both connected to the base portion, the first branch arms being positioned at a bottom side of the cavity and the second branch arms being positioned at a top side of the cavity; wherein the signal terminals are positioned at the bottom side of the cavity; wherein the actuator comprises a main plate having a plurality of grooves, wherein each groove of the plurality of grooves is adapted to at least partially receive the second branch arm of a corresponding ground terminal; and wherein every two of the signal terminals are positioned adjacent to each other and sandwiched between the first branch arms of two ground terminals.

2. The electrical connector of claim 1, wherein the housing further comprising voids each being located between two adjacent signal terminals.

3. The electrical connector of claim 1, wherein the main plate comprises a plurality of recesses formed at positions corresponding to the signal terminals, such that when the actuator is at the close position, each recess overlaps with two adjacent signal terminals.

4. The electrical connector of claim 3, wherein the plurality of grooves are located between two adjacent recesses for accommodating the second branch arm of the ground terminal.

5. The electrical connector of claim 1, further comprising a metal cover coupled to the housing, wherein the metal cover is rotatable relative to the housing between an open position to allow the actuator to move to the release position, and a close position to enclose the actuator when the actuator is at the lock position.

6. The electrical connector of claim 5, wherein the main plate comprises at least one opening formed thereon, wherein at least one of the ground terminals includes a projection extending through the at least one opening when the actuator is at the lock position.

7. The electrical connector of claim 6, wherein when at the close position, the metal cover is in contact with the at least one projection.

8. The electrical connector of claim 1, wherein the second branch arms each includes a tip inserted into the housing and a holding portion between the base portion and the tip, wherein the actuator includes a pivot disposed between the holding portion and the housing such that detachment of the actuator from the housing is prevented.

9. An electrical connector comprising: a housing having a cavity for receiving a circuit board therein; an actuator coupled to the housing and rotatable relative to the housing between a release position to allow the circuit board to be inserted into the cavity and a lock position to fix the circuit board in the cavity; signal terminals and ground terminals arranged in the housing, wherein each ground terminal includes a base portion, a first branch arm and a second branch arm both connected to the base portion, the first branch arms being positioned at a bottom side of the cavity and the second branch arms being positioned at a top side of the cavity; wherein the actuator comprises a main plate having a plurality of grooves, wherein each groove of the plurality of grooves is adapted to at least partially receive the second branch arm of a corresponding ground terminal; and wherein every two of the signal terminals are positioned adjacent to each other and sandwiched between the first branch arms of two ground terminals.

10. The electrical connector of claim 9, wherein the housing further comprising voids each being located between two adjacent signal terminals.

11. The electrical connector of claim 9, wherein the main plate comprises a plurality of recesses formed at positions corresponding to the signal terminals, such that when the actuator is at the close position, each recess overlaps with two adjacent signal terminals.

12. The electrical connector of claim 11, wherein the plurality of grooves are located between two adjacent recesses for accommodating the second branch arm of the ground terminal.

13. The electrical connector of claim 9, further comprising a metal cover coupled to the housing, wherein the metal cover is rotatable relative to the housing between an open position to allow the actuator to move to the release position, and a close position to cover the actuator when the actuator is at the lock position.

14. The electrical connector of claim 13, wherein the main plate comprises at least one opening formed thereon, wherein at least one of the ground terminals includes a projection extending through the at least one opening when the actuator is at the lock position.

15. The electrical connector of claim 14, wherein when at the close position, the metal cover is in contact with the at least one projection.

16. The electrical connector of claim 9, wherein the second branch arms each includes a tip inserted into the housing and a holding portion between the base portion and the tip, wherein the actuator includes a pivot disposed between the holding portion and the housing such that detachment of the actuator from the housing is prevented.

* * * * *